US010900731B1

(12) United States Patent
Loveday, IV et al.

(10) Patent No.: US 10,900,731 B1
(45) **Date of Patent: *Jan. 26, 2021**

(54) UNIVERSAL MULTIPLE CALIBER FIREARM MAGAZINE LOADER

(71) Applicant: Elite Tactical Systems Group, LLC, Cheyenne, WY (US)

(72) Inventors: George E. Loveday, IV, Knoxville, TN (US); George E. Loveday, III, Knoxville, TN (US)

(73) Assignee: Elite Tactical Systems Group, LLC, Cheyenne, WY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/877,283

(22) Filed: May 18, 2020

Related U.S. Application Data

(63) Continuation of application No. 16/537,500, filed on Aug. 9, 2019, now abandoned, which is a continuation of application No. 16/378,531, filed on Apr. 8, 2019, now abandoned, which is a continuation of application No. 16/041,833, filed on Jul. 22, 2018, now Pat. No. 10,254,061.

(60) Provisional application No. 62/535,951, filed on Jul. 23, 2017.

(51) Int. Cl.
*F41A 9/83* (2006.01)

(52) U.S. Cl.
CPC ..... *F41A 9/83* (2013.01)

(58) Field of Classification Search
CPC ..... F41A 9/83; F41A 9/84; F41A 9/82
USPC ..... 42/87, 88, 90; 89/33.1, 34
See application file for complete search history.

(56) References Cited

U.S. PATENT DOCUMENTS

| | | | | |
|---|---|---|---|---|
| 7,805,874 | B2 | 10/2010 | Tal | |
| 9,618,286 | B1 | 4/2017 | Plate | |
| 9,689,633 | B1 | 6/2017 | Plate | |
| 9,739,552 | B1 | 8/2017 | Plate | |
| 9,797,669 | B1 | 10/2017 | Plate | |
| 9,933,220 | B1 | 4/2018 | Plate | |
| 10,254,061 | B1 * | 4/2019 | Loveday, IV | F41A 9/84 |

OTHER PUBLICATIONS

TheFirearmBlog.com, Ray I., SmitLoad Glock Mag Loader, https://www.thefirearmblog.com/blog/2016/04/21/225273/, Apr. 21, 2016.

* cited by examiner

*Primary Examiner* — Reginald S Tillman, Jr.
(74) *Attorney, Agent, or Firm* — J. Kenneth Hoffmeister

(57) ABSTRACT

A multiple caliber firearm magazine loader. The loader provides two main features. First, the loader provides the capability to pick up rounds of ammunition in a wide variety of calibers. Second, the loader has a body that accommodates a large number of magazines with a variety of form factors and dimensions designed to work with a diverse collection of firearms. The body has multiple alignment features that align the feed opening of magazines with the rail of the loader in order to receive rounds of ammunition as they are pushed downward along the rail.

20 Claims, 4 Drawing Sheets

UNIVERSAL MULTIPLE CALIBER FIREARM MAGAZINE LOADER

BACKGROUND

For all the obvious benefits, increasing the capacity of firearm magazines has consequences. Operating with more rounds of ammunition, high capacity magazines have higher spring tensions. In double stack magazines, where the magazine funnels two columns of rounds into a single column at the feed lips, the spring force necessary to overcome the binding at the transition point is significant. In fact, the amount of force necessary to insert a round into the magazine increases with each round. This makes fully loading rounds into high capacity double stack magazines difficult. When loading multiple high capacity magazines, it is not uncommon for users to experience pain in their fingers and thumbs due to the amount of stress placed on the user's thumbs during the loading process.

Another consequence is the amount of time required to load high capacity magazines. Individually loading rounds into a magazine is a time consuming process, in and of itself. With the higher forces involved, individually loading rounds into high capacity magazines takes even longer.

Further, magazines are not universal between firearm platforms. Each magazine is designed to operatively engage the magazine well of a particular firearm platform. This means that magazines for each firearm platform has specific dimensions, shapes, and engagement features. Prior art loaders are designed to work with magazines for a single platform. It is with respect to these and other considerations that the present invention has been made.

BRIEF SUMMARY

The following summary discusses various aspects of the invention described more fully in the detailed description and claimed herein. It is not intended to be limiting and should not be used to limit the claimed invention to only such aspects or to require the invention to include all such aspects.

The multiple caliber firearm magazine loader provides two main features. First, the loader provides the capability to pick up rounds of ammunition in a wide variety of calibers. Second, the loader has a body that accommodates a large number of magazines with a variety of form factors and dimensions designed to work with a diverse collection of firearms. The body has multiple alignment features that align the feed opening of magazines with the rail of the loader in order to receive rounds of ammunition as they are pushed downward along the rail.

The magazine loader includes a body having a rail and an optional plunger. Generally, the body is shaped to be held in a user's hand. The body is configured to horizontally center many different types of magazines and place such magazines into alignment with the rail for loading. A rail extends from the top of the body. The length of the rail can be varied to hold a selected number of rounds for loading at one time without departing from the scope and spirit of the present invention.

The rail has a generally C-shaped cross section that defines a rear wall and opposing side walls. Each side wall defines a rearward portion and a forward portion. The distance separating the inner faces of the forward portions is greater than the distance separating the inner faces of the rearward portions. The rail includes a pair of rearward ribs and a pair of forward ribs. As with the side walls, the distance separating the opposing forward ribs is greater than the distance separating the opposing rearward ribs.

The forward ribs are positioned and dimensioned to engage the extractor groove of the casing of a round of larger caliber ammunition. The rearward ribs serve as a stop engaging the end of the round of larger caliber ammunition. Together the forward portion, the rearward ribs, and the forward ribs define a channel that is configured to capture rounds of larger caliber ammunition by the extractor groove.

The rearward ribs are positioned and dimensioned to engage the extractor groove of the casing of a round of smaller caliber ammunition. The inner face of the rear wall serves as a stop engaging the end of the round of smaller caliber ammunition. Together the rear wall, the rearward portion, and the rearward ribs define a channel that is configured to capture rounds of smaller caliber ammunition by the extractor groove. The distance separating the opposing forward ribs is greater than the outside dimensions of the ammunition that the smaller caliber ammunition channel is configured to capture. Accordingly, the forward ribs do not interfere with the ability to pick up rounds of smaller caliber ammunition.

The body of the loader departs from the prior art by offering a universal design that accommodates magazines for many different firearm platforms. The body includes features that allow it to hold straight or curved magazines and magazines with different dimensions. The body has an open magazine well design that includes a rear wall and two opposing side walls configured to receive a magazine. For wider magazines (e.g., an AK47 magazine), the side walls serve to horizontally center the magazine. This aligns the feed opening of the magazine with the rail allowing rounds of ammunition to be pressed between the feed lips and into the magazine. The rear wall of the magazine well is generally aligned with the inner face of the rail rear wall. The rear wall defines a stop that limits insertion of the magazine and keeps the rear wall of the magazine properly position relative to the rear wall of the rail. The rear wall defines a recess having width that is narrower than the distance between the two side walls. The recess provides secondary alignment channel that works with narrower magazines.

BRIEF DESCRIPTION OF THE DRAWINGS

Further features, aspects, and advantages of the present disclosure will become better understood by reference to the following figures, wherein elements are not to scale so as to more clearly show the details and wherein like reference numbers indicate like elements throughout the several views.

DETAILED DESCRIPTION

Aspects of a multiple caliber firearm magazine loader are described herein and illustrated in the accompanying figures. The loader provides two main features. First, the loader provides the capability to pick up rounds of ammunition in a wide variety of calibers. Second, the loader has a body that accommodates a large number of magazines with a variety of form factors and dimensions designed to work with a diverse collection of firearms. The body has multiple alignment features that align the feed opening of magazines with the rail of the loader in order to receive rounds of ammunition as they are pushed downward along the rail.

Figure 1:
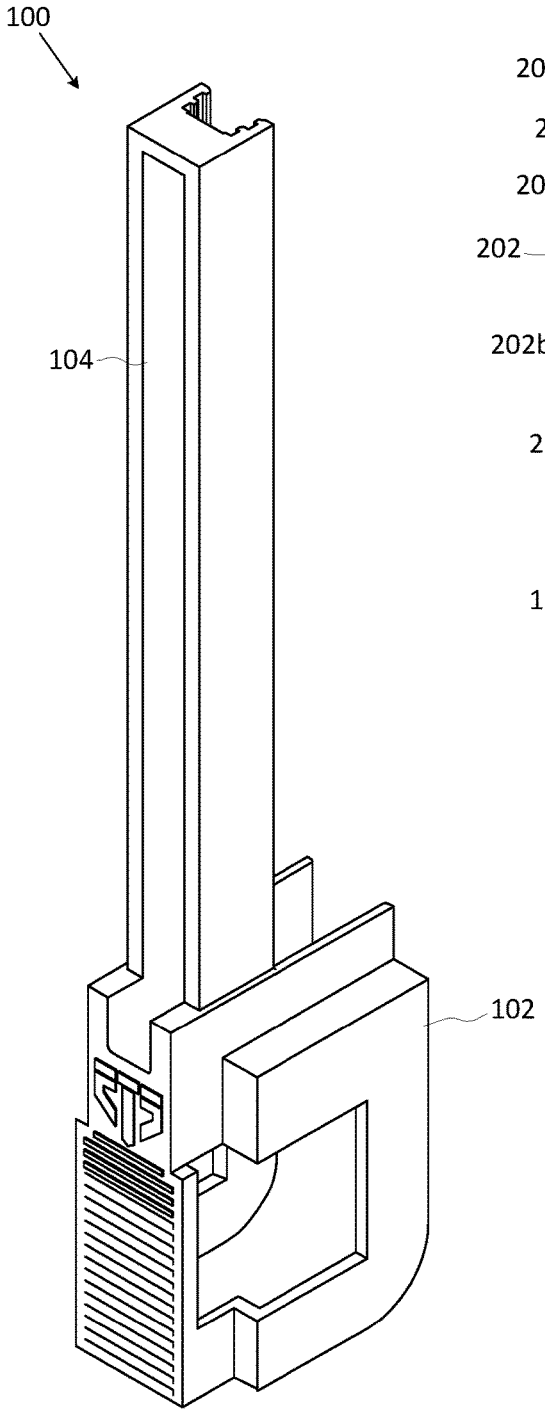
FIG. 1 is a front perspective view of an embodiment of a multiple caliber handheld firearm magazine loader according to the present invention.

FIG. 1 is a front perspective view of an embodiment of the loader illustrating aspects of the present invention. The magazine loader 100 includes a body 102 having a rail 104 and an optional plunger. Generally, the body 102 is shaped to be held in a user's hand. The body 102 is configured to horizontally center many different types of magazines and place such magazines into alignment with the rail for loading. By way of non-limiting examples, the loader 100 is capable of loading magazines for at least all of the following firearm platforms: AR15, AR10, AK47, AK74, G36®, Steyr® Aug®, MP5®, Scorpion® EVO, Colt® SMG, and UZI®. One skilled in the art will appreciate that these magazines are generally double stack, double feed magazines. The rail 104 is configured to pick up rounds of ammunition in different calibers for loading into a corresponding magazine. By way of non-limiting examples, the loader 100 is capable of loading ammunition for at least all of the following calibers: 5.56×45, .223, .308 NATO, 300BLK, 7.62×39, 5.45×39, and 9 mm.

The rail 104 extends from the top of the body 102. One optional aspect of the rail 104 includes hinging the rail 104, which allows it to fold and reduce the overall length of the loader when not in use. The length of the rail 104 can be varied to hold a selected number of rounds for loading at one time without departing from the scope and spirit of the present invention. By way of non-limiting examples, the rail 104 may be sized to hold five or ten rounds at a time.

Figure 2:
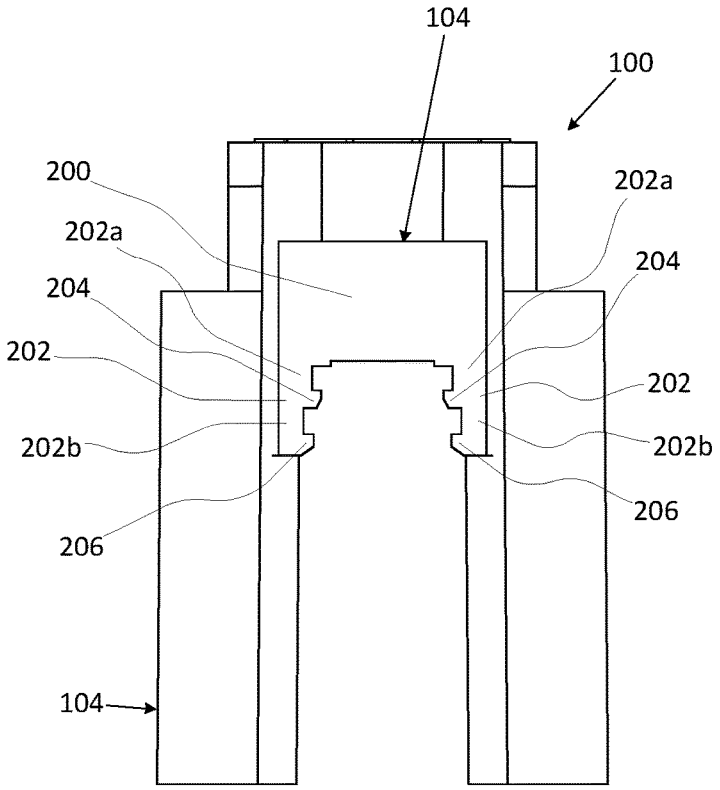
FIG. 2 is a top plan view of the loader of FIG. 1.

FIG. 2 is a top plan view of illustrating aspects of one embodiment the loader 102. The rail 105 has a generally C-shaped cross section that defines a rear wall 200 and opposing side walls 202. Each side wall defines a rearward portion 202*a* and a forward portion 202*b*. The distance separating the inner faces of the forward portions 202*b* is greater than the distance separating the inner faces of the rearward portions 202*a*. The rail 105 also includes two sets of ribs running lengthwise along the inner faces of the side walls 202. More specifically, the ribs include a pair of rearward ribs 204 and a pair of forward ribs 206. The rearward ribs 204 are located at the junction of the rearward portion 202*a* and the forward portion 202*b*. The forward ribs 206 are located at the terminal edge of the forward portions 202*b*. As with the side walls 202, the distance separating the opposing forward ribs 206 is greater than the distance separating the opposing rearward ribs 204.

The forward ribs 206 are positioned and dimensioned to engage the extractor groove of the casing of a round of larger caliber ammunition. The rearward ribs 204 serve as a stop engaging the end of the round of larger caliber ammunition. Together the forward portion 202*b*, the rearward ribs 204, and the forward ribs 206 define a channel that is configured to capture rounds of larger caliber ammunition by the extractor groove.

The rearward ribs 204 are positioned and dimensioned to engage the extractor groove of the casing of a round of smaller caliber ammunition. The inner face of the rear wall 200 serves as a stop engaging the end of the round of smaller caliber ammunition. Together the rear wall 200, the rearward portion 202*a*, and the rearward ribs 204 define a channel that is configured to capture rounds of smaller caliber ammunition by the extractor groove.

Although rounds can be individually inserted into the appropriate ammunition channel, the design is well suited for picking up multiple rounds from an ammunition tray in a single motion. This facilitates faster loader by eliminating the need to handle individual rounds. However, having a single "universal" rail that can accommodate rounds of ammunition of different calibers presents a number of unique design challenges not faced by a loader designed for use with a single caliber of ammunition.

The distance separating the opposing forward ribs 206 is greater than the outside dimensions of the ammunition that the smaller caliber ammunition channel is configured to capture. Accordingly, the forward ribs 206 do not interfere with the ability to pick up rounds of smaller caliber ammunition.

Moreover, the forward ribs 206 actually contribute to the proper functioning of the smaller caliber ammunition channel. The distance separating the rearward ribs 204 from the inner face of the rear wall 200 is large enough to accommodate the differences in the dimensions from the end wall to the extractor groove for a number of smaller ammunition calibers. However, because of the need to accommodate these dimensional differences, some rounds of smaller caliber ammunition are subject to a certain amount of pivotal movement while captured by the smaller caliber ammunition channel. In some cases, the end wall to extractor groove dimension is small enough that the round of ammunition could pivot far enough to slip past the rib on one side and be released from the smaller caliber ammunition channel. To combat this problem, the forward ribs 206 serve a stop that prevents the smaller caliber ammunition from pivoting too far to either side. This substantially reduces or eliminates the likelihood that a round of smaller caliber ammunition can escape from capture.

The ability to pick up rounds from an ammunition tray limits the maximum width of the rail 200 (i.e., the distance between the exterior faces of the side walls 202) and the maximum thickness of the side walls 202. If the rail 200 or a side wall 202 is too wide, it will not fit between two columns of ammunition in a tray.

Also important to the ability to pick up smaller caliber ammunition from a tray is the distance from the inner face of the rear wall 200 to the exterior face of the forward ribs 206. Smaller caliber ammunition is often shorter than larger caliber ammunition. If the larger caliber channel height is too great, the rearward ribs 204 are prevented from reaching the extractor groove of the round of ammunition once the forward ribs 206 make contact with the upper face of the tray.

Another aspect of the loader 100 is that it is designed to work with a wide variety of magazines. One skilled in the art will recognize that magazines are not universal between firearm platforms. Each magazine is designed to operatively engage the magazine well of a particular firearm platform. This means that magazines for each firearm platform have specific dimensions, shapes, and engagement features. Prior art loaders are designed to work with magazines for a single platform.

The body 102 of the loader 100 departs from the prior art by offering a universal design that accommodates magazines for many different firearm platforms. The body 102 includes features that allow it to hold straight or curved magazines and magazines with different dimensions.

Figure 3:
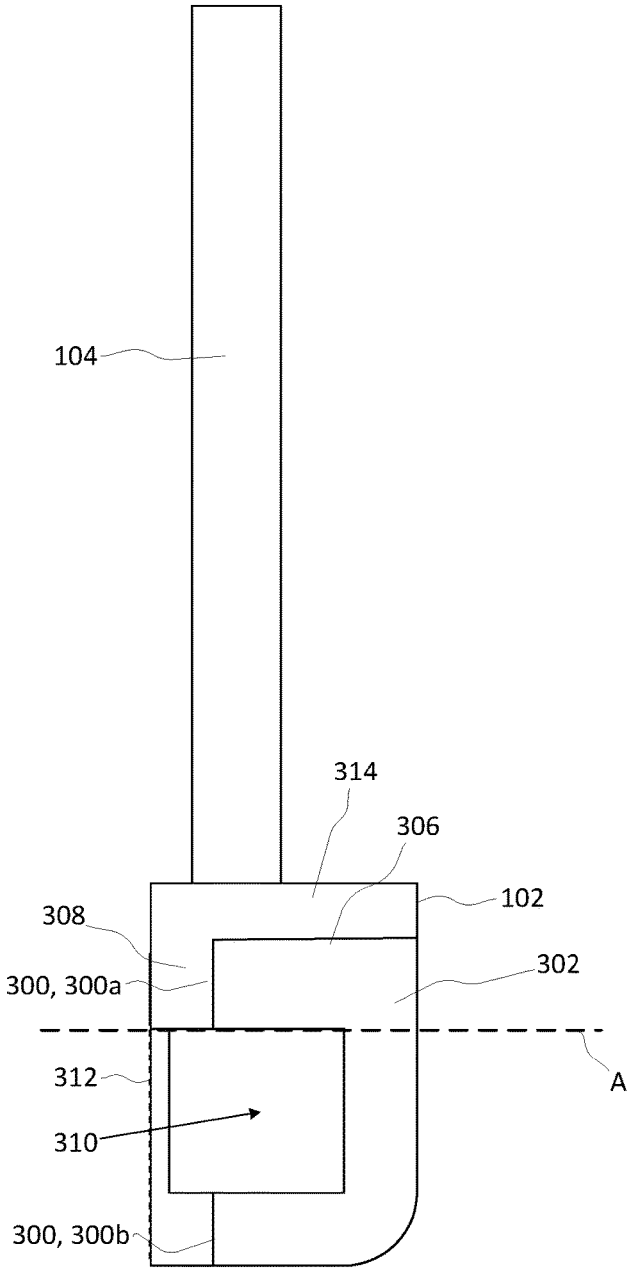
FIG. 3 is a side elevation view of the loader of FIG. 1.

FIG. 3 is a side elevation view of the loader of FIG. 1. The body 102 has an open magazine well design that includes a rear wall 300 and two opposing side walls 302 configured to receive a magazine. For wider magazines (e.g., an AK47 magazine), the side walls 302 serve to horizontally center the magazine. This aligns the feed opening of the magazine with the rail 104 allowing rounds of ammunition to be pressed between the feed lips and into the magazine. The rear wall 300 of the magazine well is generally aligned with the inner face of the rail rear wall 200. The rear wall 300 defines a stop that limits insertion of the magazine and keeps the rear wall of the magazine properly position relative to the rear wall 200 of the rail 102.

The open magazine well optionally includes one or more horizontal flanges (or top wall segments) 306 that effectively define a roof for the open magazine well. The horizontal flanges 306 are configured to operatively engage the feed lips of a magazine inserted into the body 102 such that the feed lips are perpendicular to the rail 104.

The rear wall 300 defines a recess 308 having width that is narrower than the distance between the two side walls 302. The recess 308 has two projections that optionally terminate with a continuation of the rear wall 300*c*.

In the illustrated embodiment, the rear wall 300 and the side walls 302 define a through opening 310 that separates the rear wall 300 into an upper portion 300*a* and a lower portion 300*b*. In various embodiments, the through opening 310 is further defined by the recess 308. The through opening 310 provides space for various features of selected magazines, such as the lugs of an AK47 magazine, to avoid making contact with the body 102. This prevents misalignment of the magazine with the rail 104, which interferes with proper loading of the magazine and any undue stress from such features that could damage the body 102. The through opening 310 allows for a larger body 102 with more area in contact with the magazine to provide greater stability and a greater area for the user to hold. In other embodiments, the portion of the body 102 below line A is omitted.

The recess 308 provides secondary alignment channel that works with narrower magazines. For example, magazines for the AR15 platform are narrower than magazines for the AK47 platform. Because these types of narrower magazines are not wide enough to engage the side walls 300, the side walls 300 are insufficient to align such magazines with the rail 104. However, magazines for the AR15 platform, for example, have ridges that extend from the magazine rear wall. These ridges engage or are otherwise constrained by the recess 308 to align the magazine with the rail 104. Other narrow magazines have similar features that allow the body 102 to properly align such magazines with the rail 104.

The multi-level rear wall 300 also provides a buffer area for curved magazines (e.g., AK47 magazines) to be accepted by the loader 100. When the curved magazine is inserted into the body with the feed lips properly engaging the horizontal flanges 306 (i.e., perpendicular to the rail), this buffer area provides clearance for the curved spine of the magazine.

Other aspects of the body 102 include an optional textured area 312 that facilitates the user's grip of the body while loading rounds into a magazine. An optional guide 314 above the horizontal flanges 306 reduces any sideways pivot within the rail that a round of ammunition might exhibit (i.e., straightens the alignment of the rounds) and prepares the round for insertion between the feed lips and into the magazine. The guide 314 generally has the same width as the rail 104.

Figure 4:
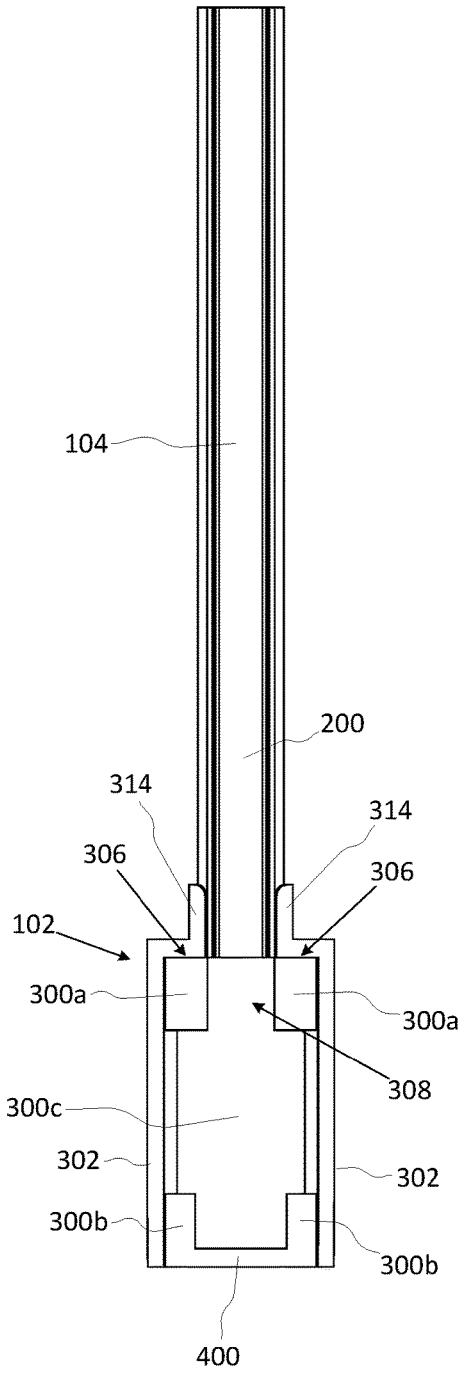
FIG. 4 is a front elevation view of the loader of FIG. 1.

FIG. 4 is a front elevation view of the loader of FIG. 1. A bottom projection 400 that compliments the lower vertical flanges of the rear wall 300*b* provides an additional stop that limits the insertion of the magazine and provides another point of alignment. The bottom projection 400 optionally provides a rest for the rear wall of a curved magazine.

Figure 5:
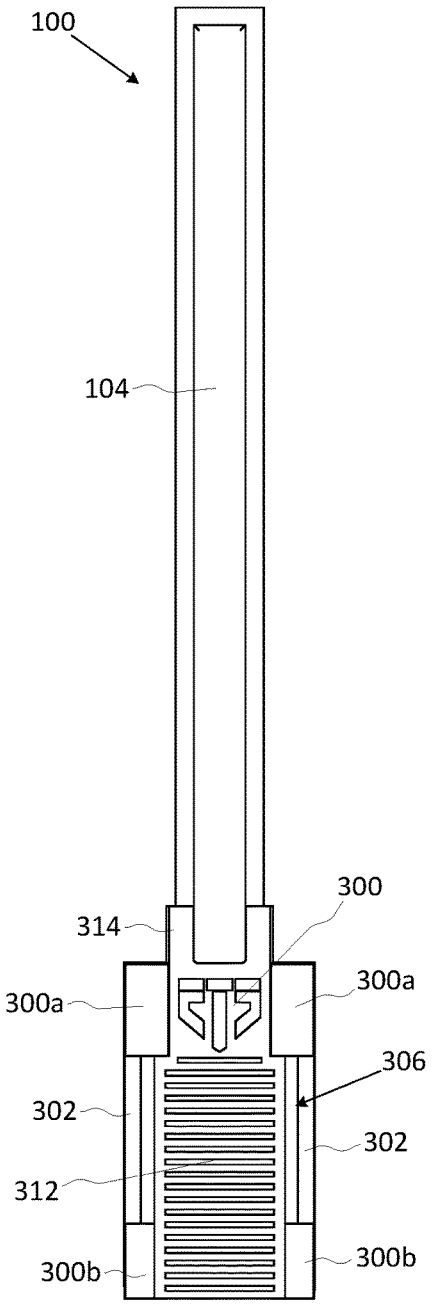
FIG. 5 is a rear elevation view of the loader of FIG. 1.
Figure 6:
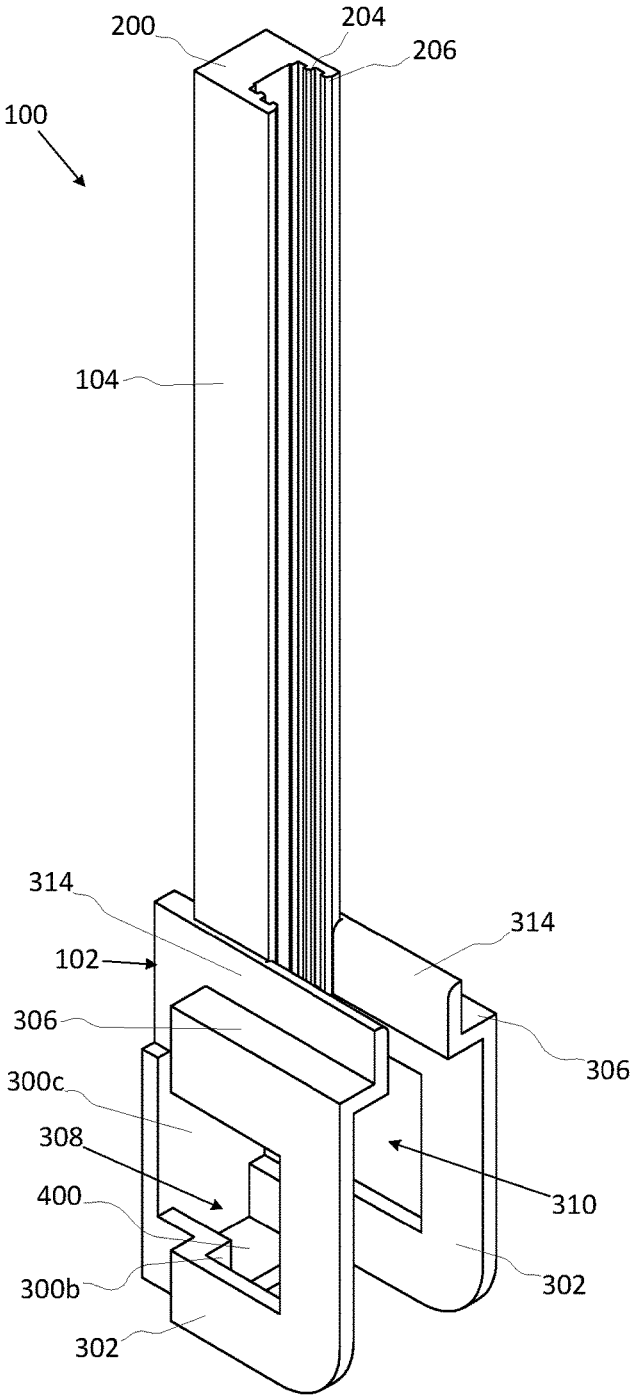
FIG. 6 is a front perspective view of the loader of FIG. 1.
Figure 7:
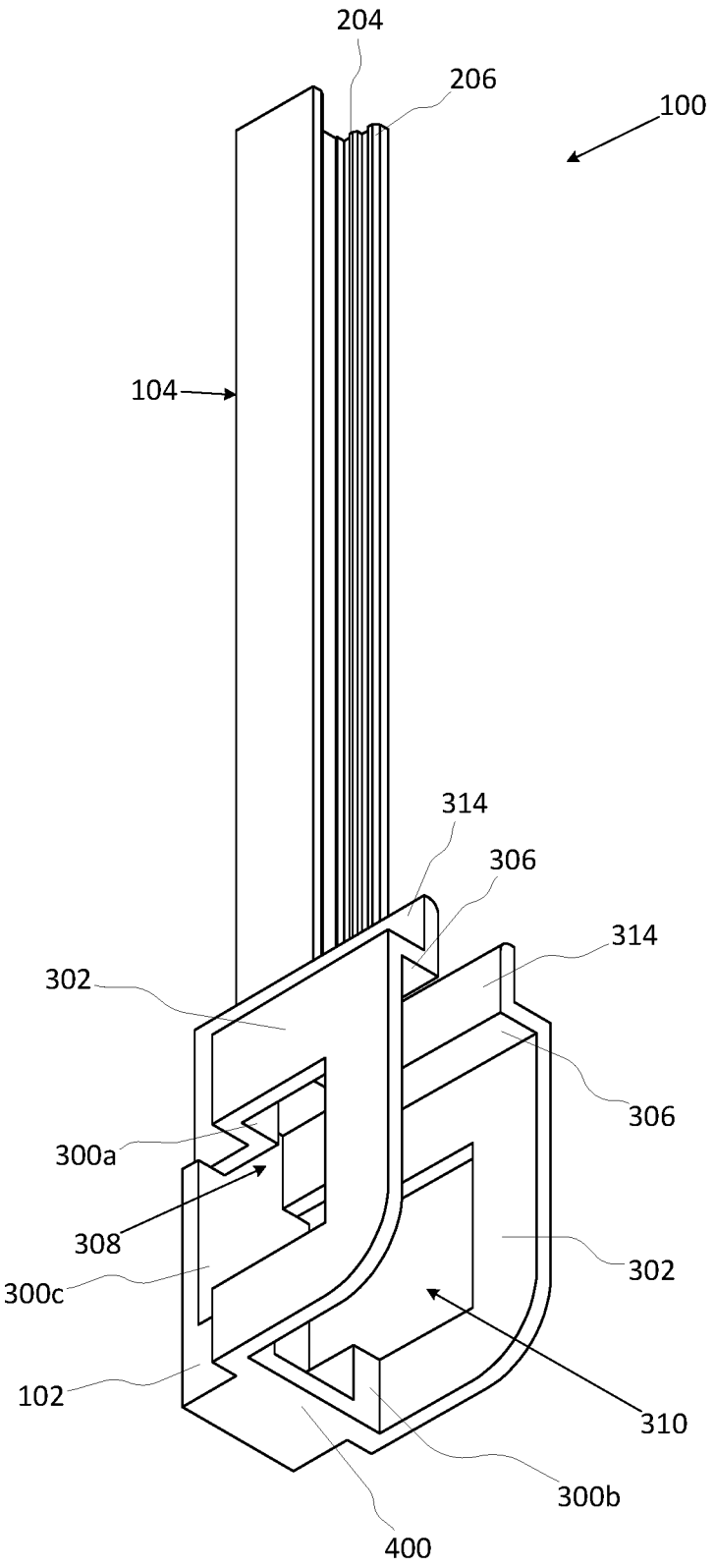
FIG. 7 is a bottom perspective view of the loader of FIG. 1.

FIG. 5 is a rear elevation view and FIGS. 6 and 7 are front and bottom perspective views showing additional views of the various aspects of the loader described herein.

The above specification, examples, and data provide a complete description of the manufacture and use of the composition of the invention. Since many implementations of the invention can be made without departing from the spirit and scope of the invention, the invention resides in the claims hereinafter appended.

What is claimed is:

1. A multiple caliber firearm magazine loader for loading a magazine having feed lips, the multiple caliber firearm magazine loader comprising:

a rail having a rear wall and two opposing side walls, each side wall defining a rearward portion and a forward portion, each side wall having a pair of rearward ribs and a pair of forward ribs, the rearward ribs being positioned at the end of the rearward portion, the forward ribs being positioned at the end of the forward portion, the forward ribs configured to operatively engage an extraction groove in a round of ammunition allowing the rail to carry the round of ammunition for loading into a magazine, the rearward ribs configured to operatively engage an extraction groove in a round of ammunition allowing the rail to carry the round of ammunition for loading into the magazine, the forward ribs configured to receive rounds of larger caliber ammunition than the rearward ribs; and a body having at least one wall, the body configured to engage a magazine and align the magazine with the rail.

2. The multiple caliber firearm magazine loader of claim 1 wherein the body has two side walls and two upper flanges, each upper flange extending inwardly from the top of one of the side walls to partially enclose the top of the body and define a channel configured to allow a round of ammunition to pass through when being loaded into a magazine.

3. The multiple caliber firearm magazine loader of claim 1 wherein the upper flanges are configured to engage the feed lips of the magazine and orient the feed lips perpendicular to the rail.

4. The multiple caliber firearm magazine loader of claim 1 wherein the body has a rear wall and two side walls and further comprising two rear wall flanges positioned forward of and substantially parallel to the rear wall, each rear wall flange extending orthogonally from the back of one of the side walls to partially enclose the top of the body.

5. The multiple caliber firearm magazine loader of claim 4 wherein the rear wall flanges serve as a stop to limit insertion of a magazine into the body and align the magazine with the rail.

6. The multiple caliber firearm magazine loader of claim 1 wherein the distance between the inner faces of the forward portions is greater than the distance between the inner faces of the rearward portions.

7. The multiple caliber firearm magazine loader of claim 1 wherein the body has two side walls, each body side wall defines a through opening for accepting extensions from the sides of a magazine.

8. The multiple caliber firearm magazine loader of claim 1 wherein the body has two side walls and two upper flanges and further comprising a pair of guides extending upwardly from the upper flanges, the guides straightening the alignment of rounds of ammunition entering the body.

9. A multiple caliber firearm magazine loader for loading rounds of ammunition having extractor grooves into a magazine, the multiple caliber firearm magazine loader comprising:

a rail having a rear wall and a pair of side walls, the rail further having a first set of ribs and a second set of ribs extending inwardly, each set of ribs configured to engage the extractor groove of a round of ammunition, the first set of ribs positioned between the rear wall and the approximate midpoint of the side walls, the second set of ribs positioned proximate to the end of the side walls distal from the rear wall, the first set of ribs and the rear wall defining a first channel, the second set of ribs and the first set of ribs defining a second channel; and a body having a rear wall and two side walls, the rear wall forming a stop for a magazine inserted into the body, the body being configured to center the magazine and align the magazine with the rail to allow the round of ammunition carried by the rail to be loaded into magazine.

10. The multiple caliber firearm magazine loader of claim 9 wherein the rear wall has a stair-stepped shape defining a recess, the rear wall having a pair of forward segments perpendicular to the side walls, a pair of steps extending rearward from and being substantially perpendicular to the forward segments, and a rear segment extending between the pair of steps and being substantially parallel to the rear wall.

11. The multiple caliber firearm magazine loader of claim 10 further comprising a bottom projection at the bottom of the forward segments and extending between the steps, the bottom projecting serving as a rest for curved magazines.

12. The multiple caliber firearm magazine loader of claim 10 wherein the bottom wall and the steps define an area for receiving curved magazines and features extending from the rear of the magazine thereby allowing for proper alignment of such magazines.

13. The multiple caliber firearm magazine loader of claim 9 wherein the side walls define though openings for receiving features extending from the sides of the magazine.

14. The multiple caliber firearm magazine loader of claim 9 wherein the body includes two top wall segments configured to engage the feed lips of the magazine.

15. The multiple caliber firearm magazine loader of claim 9 wherein the distance between the first set of ribs is greater than the distance between the second set of ribs such that the first channel is configured to carry smaller rounds of ammunition than the second channel.

16. The multiple caliber firearm magazine loader of claim 9 wherein the second set of ribs serve as stops for limiting the lateral movement of an ammunition round carried by the first channel.

17. The multiple caliber firearm magazine loader of claim 9 further comprising a pair of guides extending upwardly from the upper flanges, the guides straightening the alignment of rounds of ammunition entering the body.

18. A multiple caliber firearm magazine loader comprising:

a rail having a rear wall and two opposing side walls, each side wall defining a rearward portion and a forward portion, the distance between the inner faces of the forward portions being greater than the distance between the inner faces of the rearward portions, each side wall having a pair of rearward ribs and a pair of forward ribs, the rearward ribs being positioned at the end of the rearward portion, the forward ribs being positioned at the end of the forward portion, the forward ribs configured to operatively engage an extraction groove in a round of ammunition allowing the rail to carry the round of ammunition for loading into a magazine, the rearward ribs configured to operatively engage an extraction groove in a round of ammunition allowing the rail to carry the round of ammunition for loading into the magazine, the forward ribs configured to receive rounds of larger caliber ammunition than the rearward ribs; and a body having at least one horizontal flange configured to engage the magazine and align the magazine with the rail to allow the round of ammunition carried by the rail to be loaded into magazine.

19. The multiple caliber firearm magazine loader of claim 18 wherein the body includes at least one side wall configured to assist with centering the magazine and align the magazine with the rail, each side wall defining a through opening for accepting extensions from the sides of a magazine, the side walls being configured to center the magazine and align the magazine with the rail.

20. The multiple caliber firearm magazine loader of claim 19 wherein the body further comprises a rear wall defining a recess having a width less than the distance between the side walls.

* * * * *